US010473327B2

(12) United States Patent
Ristic et al.

(10) Patent No.: US 10,473,327 B2
(45) Date of Patent: Nov. 12, 2019

(54) SYSTEM AND METHOD FOR INCREASING THE CONCENTRATION OF PULVERIZED FUEL IN A POWER PLANT

(71) Applicant: GENERAL ELECTRIC TECHNOLOGY GMBH, Baden (CH)

(72) Inventors: Dragisa Ristic, Wendlingen (DE); Klemens Jakob Harter, Stuttgart (DE); Frank Michael Kluger, Schwaebisch Gmuend (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 606 days.

(21) Appl. No.: 15/177,650

(22) Filed: Jun. 9, 2016

(65) Prior Publication Data

US 2017/0356643 A1 Dec. 14, 2017

(51) Int. Cl.
*F23D 1/00* (2006.01)
*F23Q 13/00* (2006.01)

(52) U.S. Cl.
CPC ..... *F23D 1/00* (2013.01); *F23C 2900/03005* (2013.01); *F23C 2900/99005* (2013.01); *F23D 2201/00* (2013.01); *F23D 2201/20* (2013.01); *F23D 2207/00* (2013.01); *F23Q 13/00* (2013.01)

(58) Field of Classification Search
CPC ..... F23D 2201/20
See application file for complete search history.

(56) References Cited

U.S. PATENT DOCUMENTS 51,561 A 12/1865 Costolo
3,934,522 A * 1/1976 Booker ..... F23D 1/00 110/263
4,807,541 A * 2/1989 Masai ..... F23D 17/00 110/262
4,934,284 A * 6/1990 Nitz ..... F23D 1/00 110/232
5,937,770 A * 8/1999 Kobayashi ..... F23D 1/00 110/104 B
8,555,795 B2 * 10/2013 Cheng ..... F23D 1/00 110/104 B (Continued)

FOREIGN PATENT DOCUMENTS

CN 1786579 A 6/2006
CN 201170548 Y 12/2008

(Continued)

OTHER PUBLICATIONS

International Search Report and Written Opinion issued in connection with corresponding PCT Application No. PCT/EP2017/063870 dated Oct. 11, 2017.

*Primary Examiner* — David J Laux
(74) *Attorney, Agent, or Firm* — Grogan, Tuccillo & Vanderleeden, LLP

(57) ABSTRACT

A pre-ignition conduit for a pulverized fuel nozzle includes a duct having first and second opposing end portions, the first end portion configured to face an outlet of an igniter. The conduit further includes a cone-shaped concentrator for collecting and forwarding pulverized fuel into the duct for ignition, the cone-shaped concentrator being secured to the first end portion and located between the outlet of the igniter and the duct. The pre-ignition conduit functions as an ignition chamber within a pulverized fuel nozzle.

24 Claims, 9 Drawing Sheets

(56) References Cited

U.S. PATENT DOCUMENTS

Figure 1:
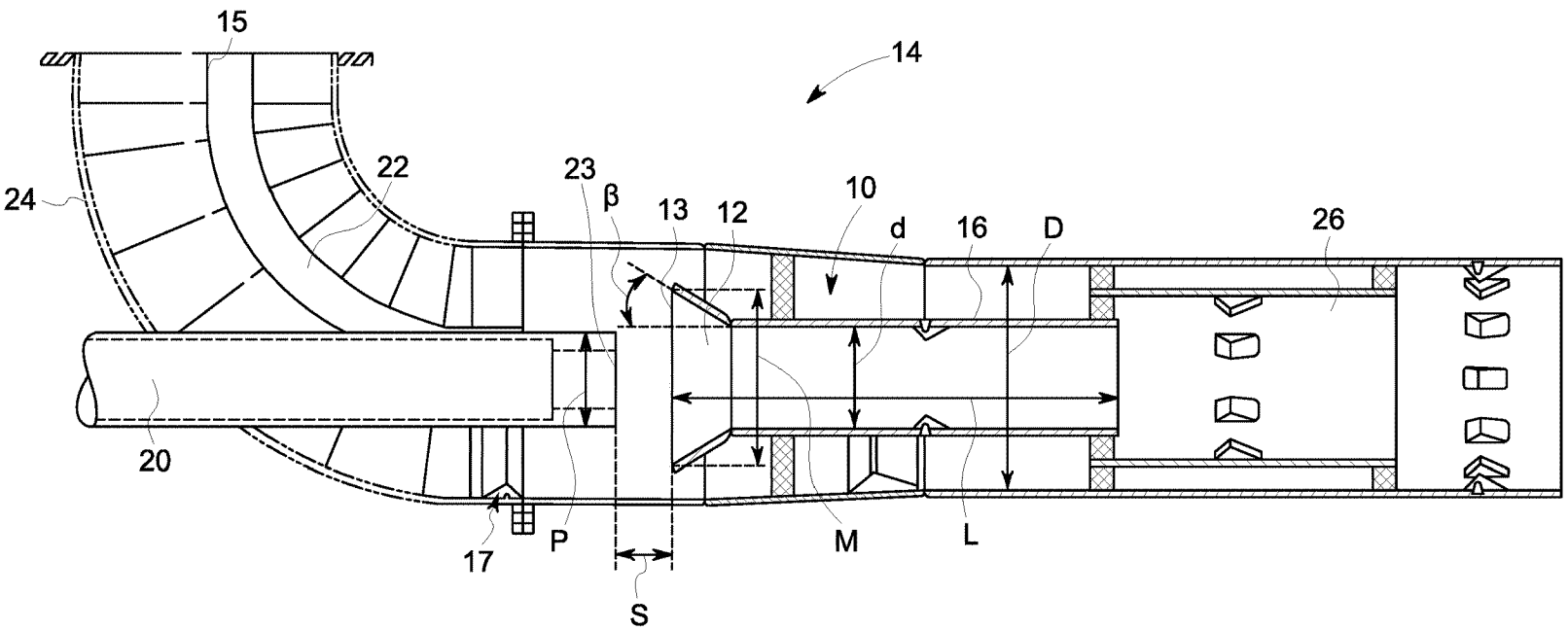

2013/0333676 A1 12/2013 Zheng et al.

FOREIGN PATENT DOCUMENTS

| | | | |
|---|---|---|---|
| CN | 201377792 | Y | 1/2010 |
| EP | 2172706 | A1 | 4/2010 |
| EP | 2253884 | A1 | 11/2010 |
| WO | 2009/143725 | A1 | 12/2009 |
| WO | 2012088110 | A1 | 6/2012 |

* cited by examiner

SYSTEM AND METHOD FOR INCREASING THE CONCENTRATION OF PULVERIZED FUEL IN A POWER PLANT

BACKGROUND

Technical Field

Embodiments of the invention relate generally to pulverized fuel power plants. Certain embodiments relate to systems and methods for increasing the concentration of pulverized fuel in a pre-ignition conduit of a pulverized fuel burner.

Discussion of Art

Pulverized fuel power plants have typically burned oil or natural gas to initially ignite the pulverized fuels, e.g., coal, that are to be combusted. As will be appreciated, this results in the consumption of large amounts of oil and gas. To reduce such consumption, plasma ignition systems have been developed to replace oil or gas ignition systems. More specifically, many plasma ignition systems use multi-stage, i.e., 'stage-by-stage' ignition technology to ignite pulverised fuels. In stage-by-stage systems, a relatively long pulverized fuel nozzle is employed that includes at least one and typically two or more ignition chambers located within the nozzle.

More specifically, in such systems, primary airflow containing pulverized fuel is ignited through the action of plasma generator to produce a plasma cloud in a first ignition chamber thereby generating a 'first stage' pulverized fuel flame. The first stage flame then ignites the pulverized fuel containing primary airflow in a second stage chamber, thereby forming a 'second stage' pulverized fuel flame. Finally, the ignited fuel enters into the furnace and reacts with oxygen in combustion air supplied through the burner, thereby forming a final stage flame.

Generally, the concentration of pulverized fuel in the ignition chambers is determined by a guide plate located in an elbow portion of a pulverized fuel nozzle. More specifically, the guide plate aligns the flow of pulverized fuel and primary air flow such that they are parallel to the plasma cloud. The guide plate also concentrates the pulverized fuel in proximity to a central axis of the burner and plasma cloud via a centrifugal separation effect. This, in turn, increases the concentration of the pulverized fuel entering the chamber, which facilitates ignition.

Due to space limitations within pulverized fuel nozzles, however, the pulverised fuel concentration in the chambers cannot easily be increased without affecting ignition behavior. As such, there is a need for a system and method for increasing the concentration of pulverized fuel that differs from those systems that are currently available.

BRIEF DESCRIPTION

In an embodiment, a pre-ignition conduit for a pulverized fuel nozzle includes a duct having first and second opposing end portions, the first end portion configured to face an outlet of an igniter. The conduit further includes a cone-shaped concentrator for collecting and forwarding pulverized fuel into the duct for ignition, the cone-shaped concentrator being secured to the first end portion and located between the outlet of the igniter and the duct. The pre-ignition conduit functions as an ignition chamber within the pulverized fuel nozzle.

In another embodiment, a pulverized fuel nozzle for a burner includes an igniter having an outlet, a pre-ignition conduit that includes a duct have first and second opposing end portions, the first end portion configured to face the outlet of the igniter and a cone-shaped concentrator for collecting and forwarding pulverized fuel into the duct for ignition, the cone-shaped concentrator being secured to the first end portion and located between the outlet of the igniter and the duct. The pre-ignition conduit functions as an ignition chamber within the pulverized fuel nozzle.

In yet another embodiment, a pre-ignition conduit for a pulverized fuel nozzle includes a duct having first and second opposing end portions, the first end portion configured to face an outlet of an igniter, a cone-shaped concentrator for collecting and forwarding pulverized fuel into the duct for ignition, the cone-shaped concentrator being secured to the first end portion and located between the outlet of the igniter and the duct. The duct further including an ignition inlet for receipt of an ignition source.

DRAWINGS

The present invention will be better understood from reading the following description of non-limiting embodiments, with reference to the attached drawings, wherein below:

FIG. 1 schematically depicts a pulverized fuel nozzle and pre-ignition conduit according to an embodiment of the present invention.

Figure 2A:
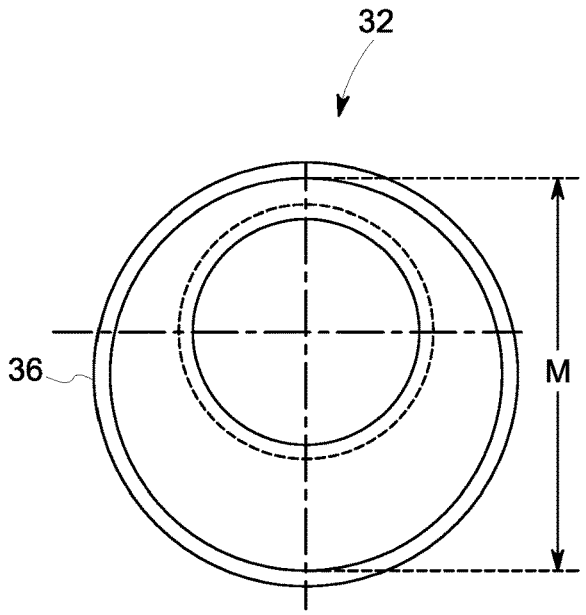

FIG. 2A schematically depicts an end view of a pre-ignition conduit with an eccentric cone-shaped concentrator according to another embodiment of the present invention.

Figure 2B:
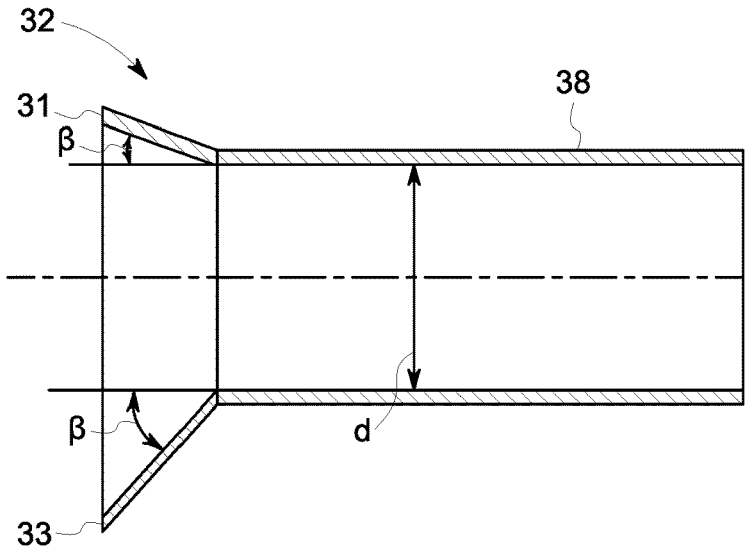

FIG. 2B schematically depicts a sectioned side view of the pre-ignition conduit of FIG. 2A.

Figure 3A:
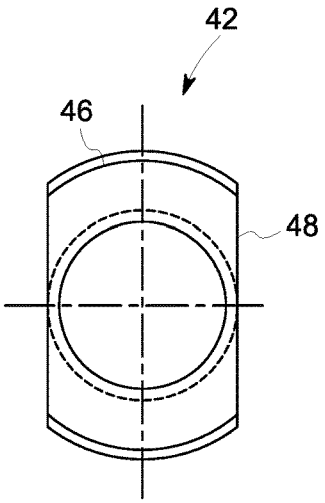

FIG. 3A schematically depicts an end view of a pre-ignition conduit with cone-shaped concentrator according to another embodiment of the present invention.

Figure 3B:
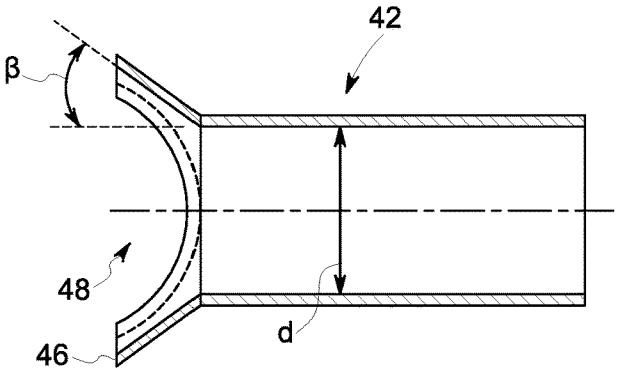

FIG. 3B schematically depicts a cut away side view of the pre-ignition conduit of FIG. 3A.

Figure 3C:
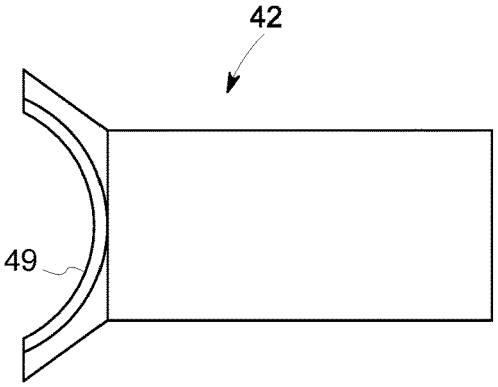

FIG. 3C schematically depicts another side view of the pre-ignition conduit of FIG. 3A.

Figure 4A:
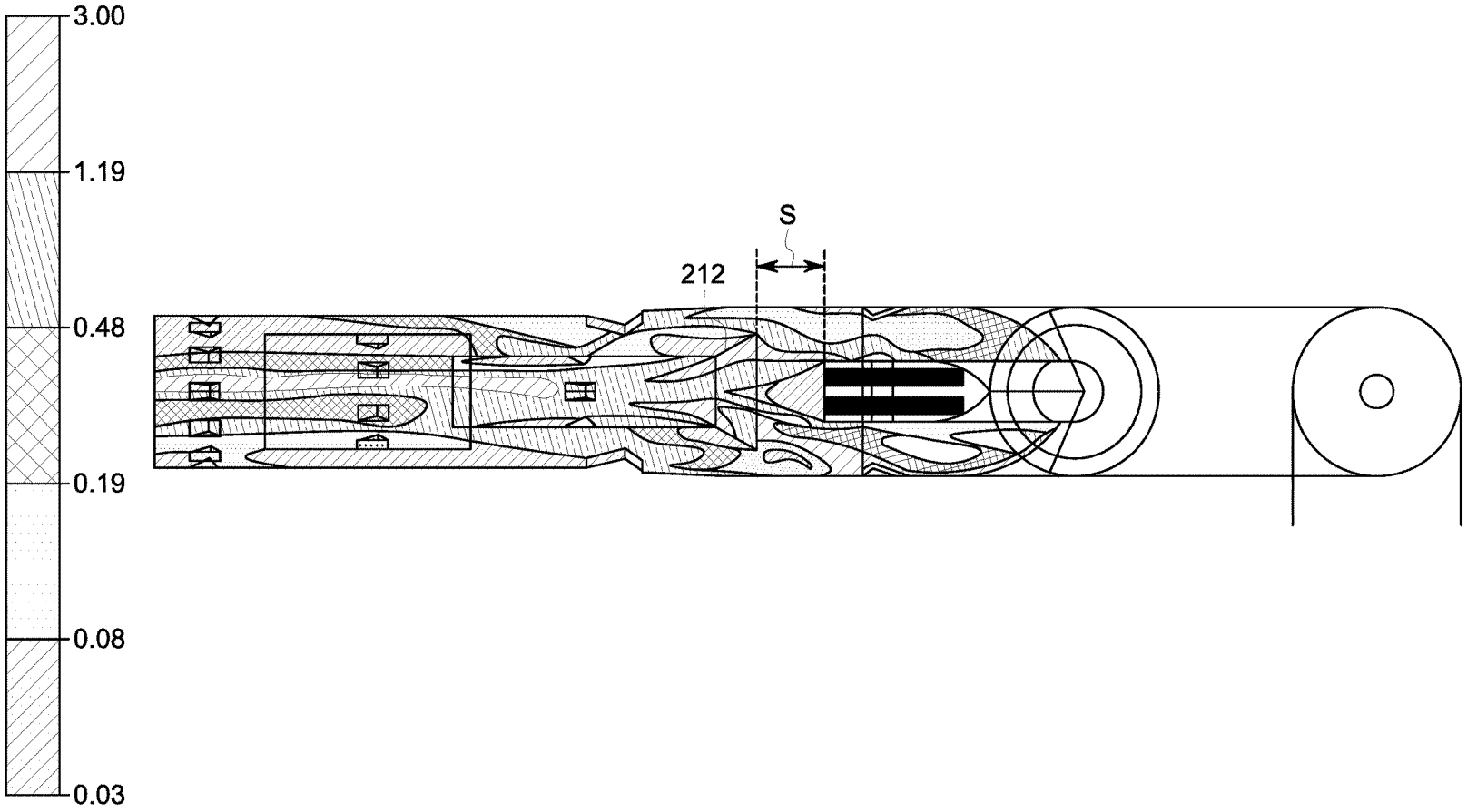
Figure 4B:
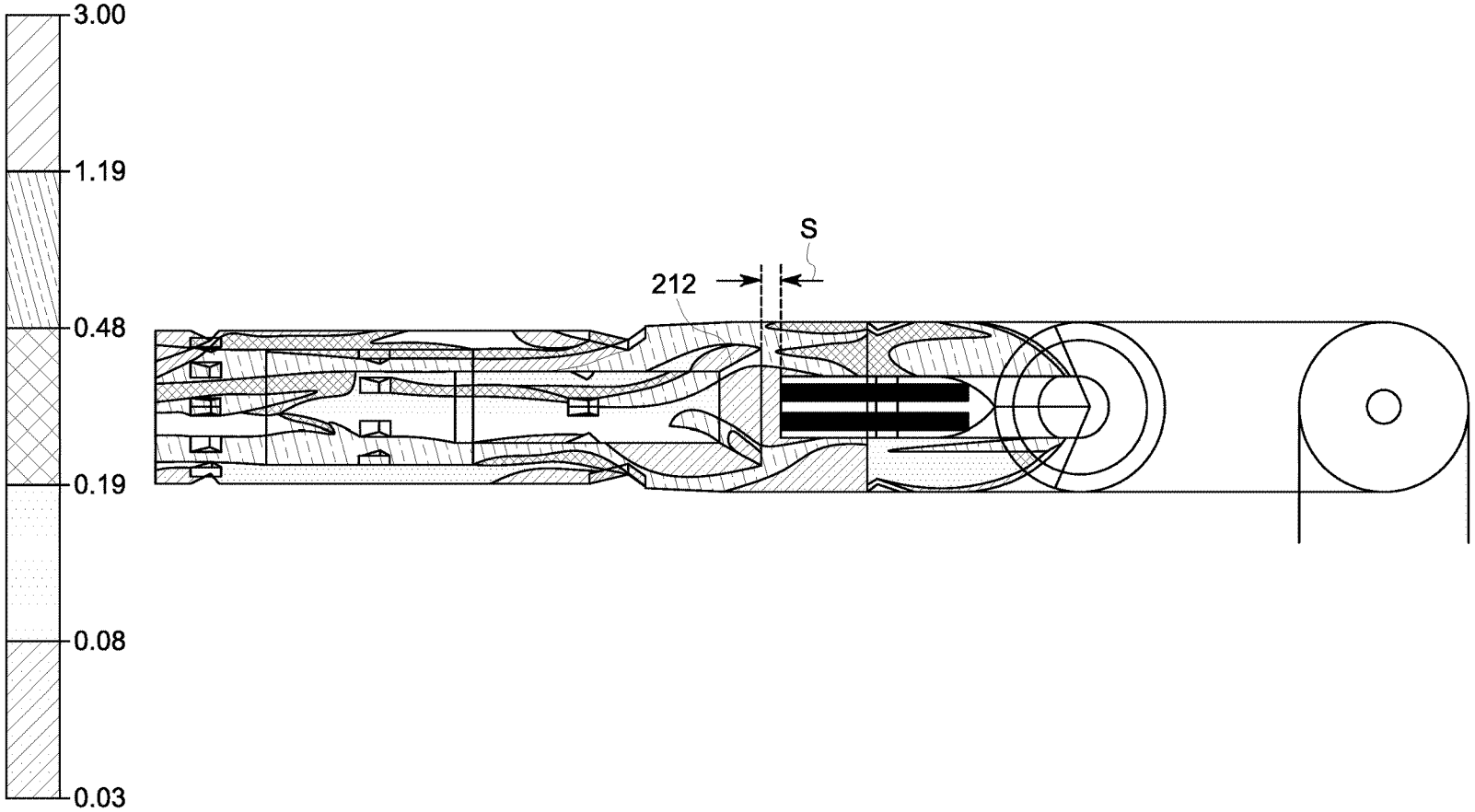
Figure 4C:
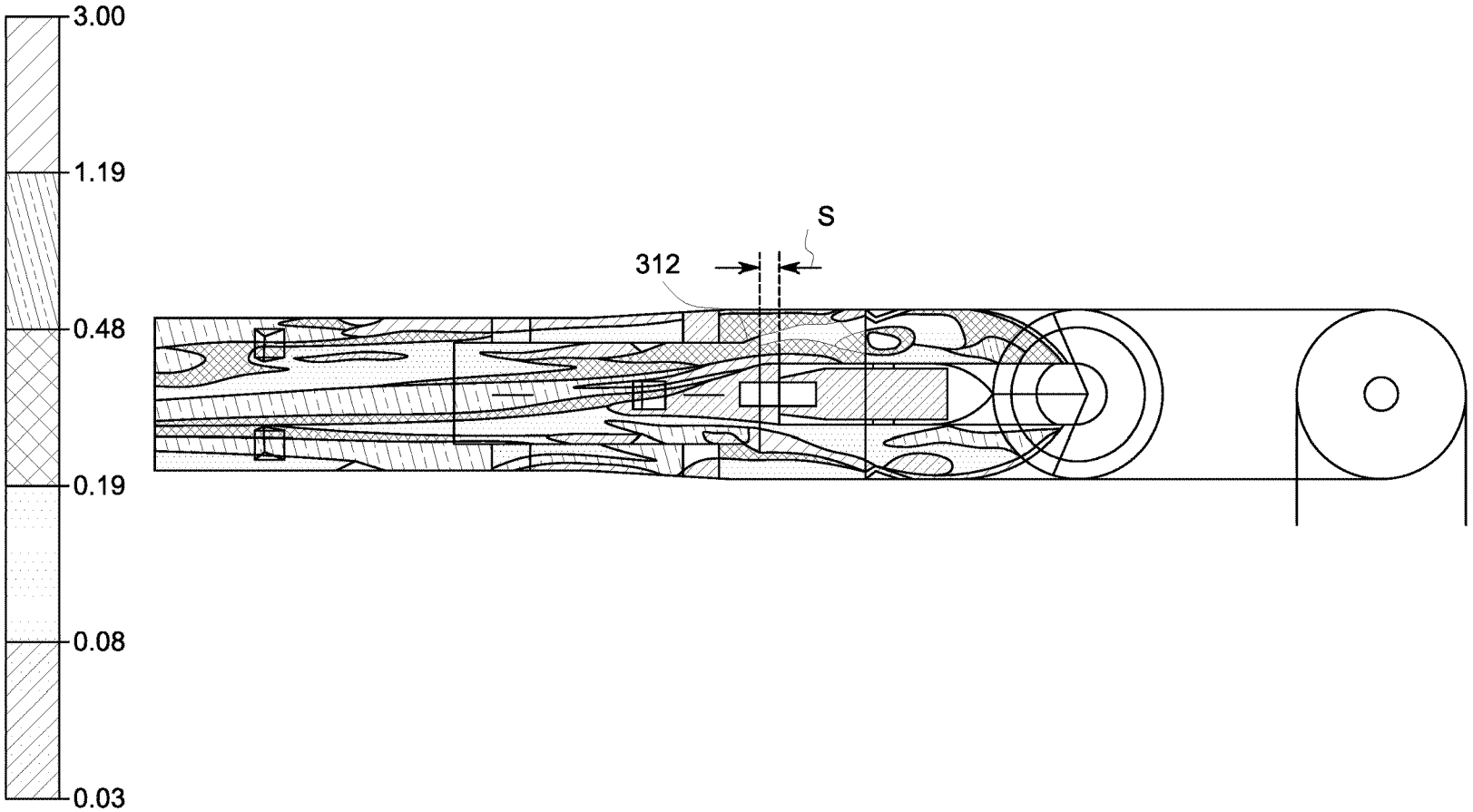
Figure 5:
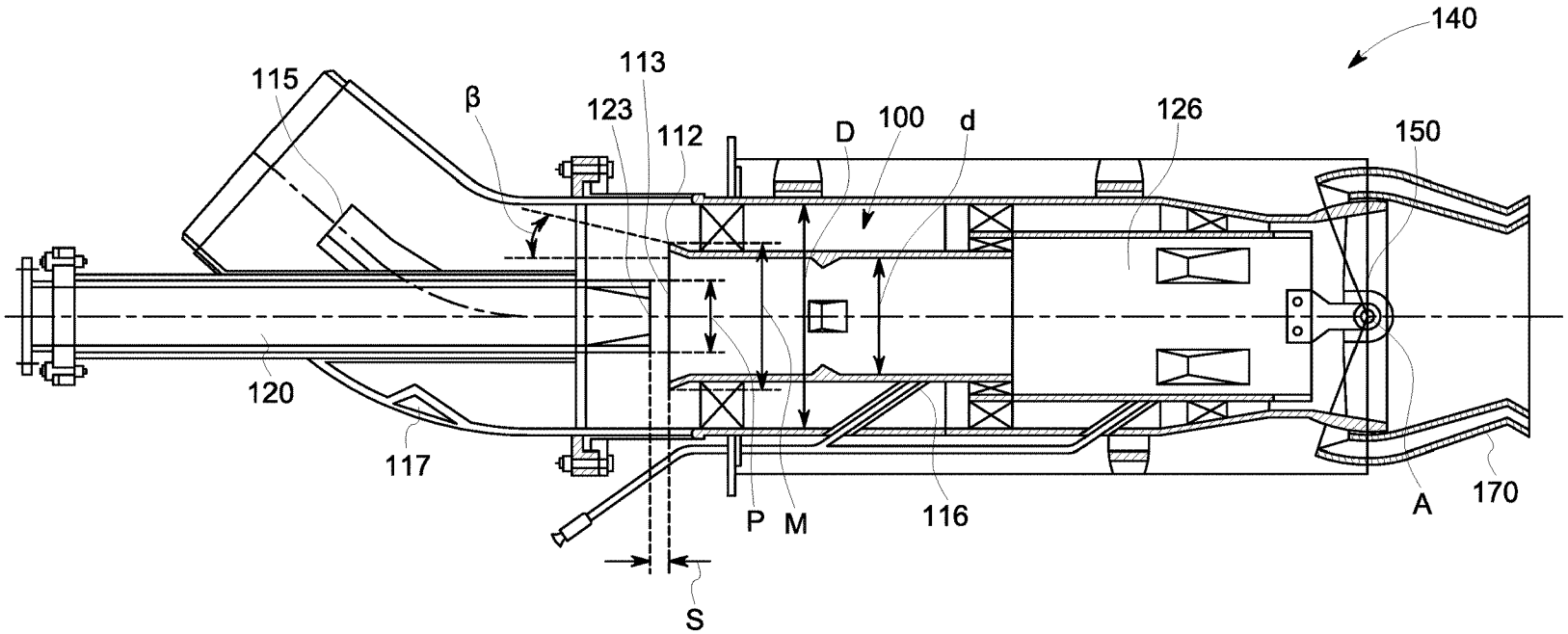

FIGS. 4A-4C graphically illustrate that a pulverized fuel and air concentration in a pre-ignition conduit varies based on igniter spacing and concentrator geometry, in accordance with embodiments of the invention, FIG. 5 schematically illustrates a pulverized fuel nozzle and pre-ignition conduit that includes a tilt mechanism, according to embodiments of the present invention.

Figure 6A:
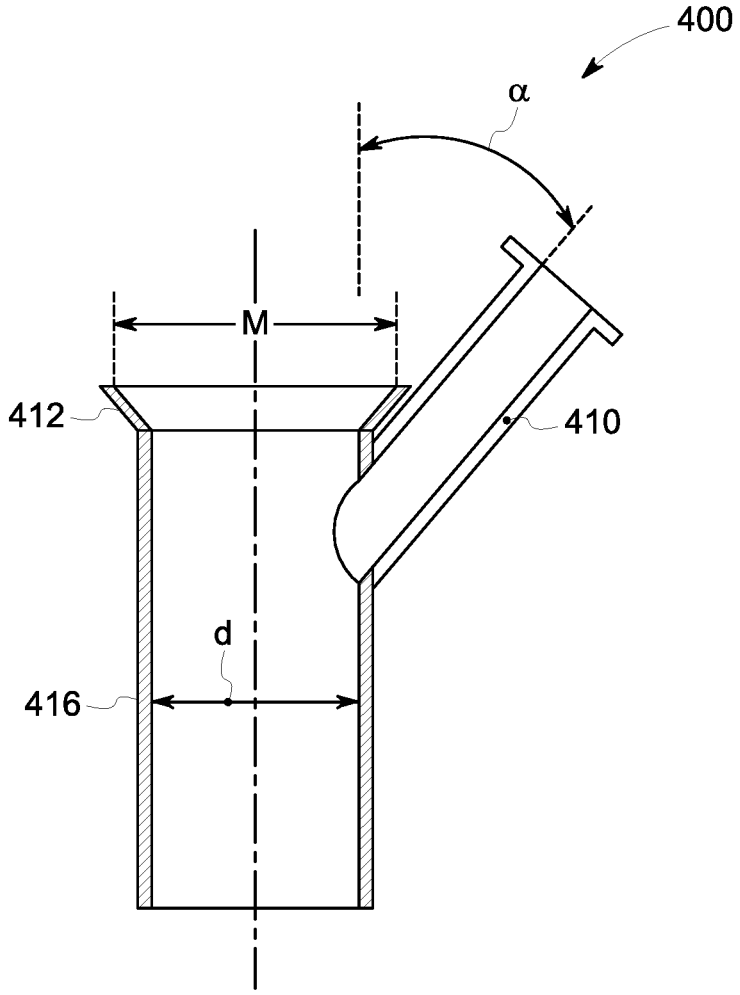
Figure 6B:
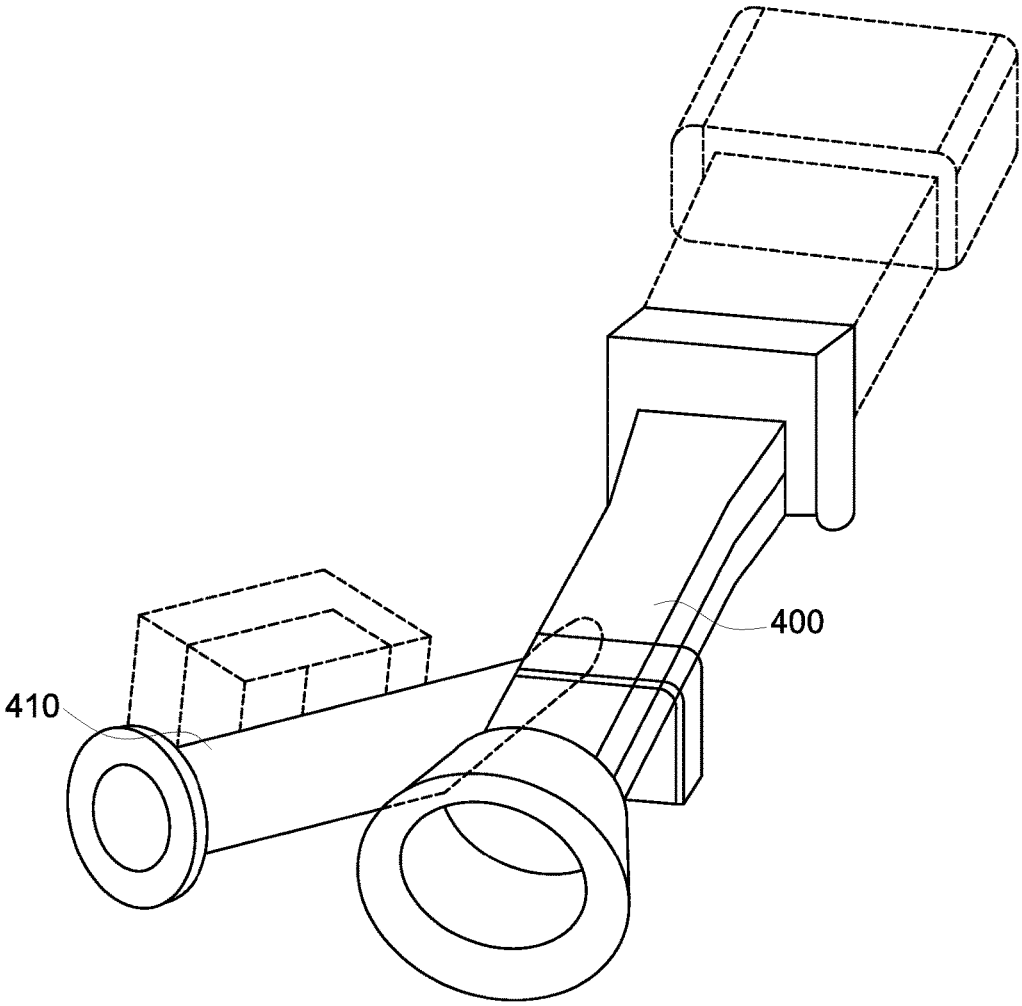

FIGS. 6A and 6B are plan and perspective views of a pre-ignition conduit that includes an igniter inlet according to embodiments of the invention.

DETAILED DESCRIPTION

Reference will be made below in detail to exemplary embodiments of the invention, examples of which are illustrated in the accompanying drawings. Wherever possible, the same reference characters used throughout the drawings refer to the same or like parts. While embodiments of the invention are described as suitable for use with pulverized coal burners, embodiments of the invention may be suitable for use with various fuels, such as fossil fuels or biomass. Accordingly, the term "pulverised fuel" or "PF" as used herein includes, but is not limited to, the aforementioned exemplary fuels. Moreover, while embodiments are described as being configured for use with a plasma generator/torch, embodiments may be used with other igniters, such as oil/gas igniters, e.g., an oil/gas gun or "micro" oil/gas burner. Moreover, embodiments may be equally suitable for use with multi-stage, e.g., stage-by-stage ignition systems, or single stage systems.

Referring now to FIGS. 1 and 2, an embodiment of the present invention configured for use in a stage-by-stage ignition system is illustrated. As shown, the embodiment includes a pre-ignition conduit 10, which is located within a pulverized fuel nozzle 14. The pre-ignition conduit 10 includes a cone-shaped concentrator 12 and a duct 16. In use, concentrated pulverized fuel, e.g., powdered coal, is provided by a guide plate 15 in an elbow portion of the nozzle, which guides the PF toward the igniter/plasma generator 20 and pre-ignition conduit 10. That is, the plate 15 directs the flow of PF and primary air so that it is substantially parallel to the igniter and concentrates the same in proximity to a central axis of the igniter and burner. In certain embodiments, the concentrated PF may also be guided toward the igniter 20 and conduit 10 through the use of a kicker 17. The concentrated PF then enters the cone-shaped concentrator 12 located upstream the duct 16. The cone-shaped concentrator 12 serves to efficiently collect the concentrated pulverized fuel and forward it into the duct 16 where it is ignited.

Embodiments of the present invention provide improved concentration of pulverized fuel in the pre-ignition conduit through the use of the cone-shaped concentrator and/or one or more geometric relationships between the nozzle 14, duct 16, cone-shaped concentrator 12 and igniter/plasma generator 20. In view of the improved concentration of PF in the pre-ignition conduit, in embodiments, the inventive pre-ignition conduit functions itself as an ignition chamber within a pulverized fuel nozzle. As a result, a stage-by-stage system can be achieved via a nozzle that includes the present pre-ignition conduit and a single conventional ignition chamber, such as chamber 26 in FIG. 1.

Referring again to FIG. 1, as mentioned, the present invention utilizes a cone-shaped concentrator 12. The concentrator 12 has a generally uniformly shaped circular cone with a continuous, circumferential edge portion 13 that, in embodiments, is at a substantially uniform distance S from the igniter/plasma generator outlet 23. The concentrator is operatively connected to the duct 16 via, for example, a weld, or, in other embodiments, it may be formed with the duct 16 as a unitary structure.

In certain embodiments, the cone-shaped concentrator 12 has a concentrator angle β which is between about 5° to about 45° and further between about 15° to about 30° to optimize pressure drop, concentrator erosion, and pulverised fuel concentration. More specifically, it has been determined that if the concentrator angle β is <15°, the pressure drop and erosion are minimal, but pulverised fuel concentration in the pre-ignition conduit is decreased. If the angle β is >30°, the pulverised fuel concentration is enhanced, but pressure drop and erosion are increased. As such, in certain embodiments, the aforementioned ranges optimize these parameters. As will be appreciated, however, in other embodiments concentrator angles varying from the above may be employed, as long as the aforementioned factors are suitably optimized.

Referring now to FIGS. 2A and 2B, in embodiments, the cone shaped concentrator 32 may have an eccentric/oblique circular cone shape. As shown, the continuous, circumferential edge portion 36 extends from a shorter cone portion 31 to a longer, extended cone portion 33. In such embodiments, the concentrator angle β varies, for example, the angle may transition from about 45° at the longer portion 33, to a smaller angle at the shorter portion 31. In such embodiments, the angles β are again between about 5° and about 45°. By varying the length and shape of the cone, one can collect pulverised fuel from areas where the pulverized fuel concentration is higher and collect less primary air with a low PF concentration. In other words, the eccentric/oblique shaped cone can be used to collect and transport enhanced amounts of pulverized fuel with less primary air into the duct 38 for combustion.

As shown in FIGS. 3A-3C, in other embodiments, the cone-shaped concentrator 42 includes a circumferential edge portion 46 that includes one or more, e.g., two, voids or discontinuities 48. As shown, the discontinuities may be arcuate, cut-away sections, though other shapes may be employed. In embodiments, the discontinuities 48 may have a chamfered or bevelled portion 49. It is also possible for embodiments with discontinuities 48 to have an eccentric/oblique cone shape as shown in FIGS. 2A and 2B. As will be appreciated, these cone embodiments also selectively collect primary air with higher concentrations of pulverized fuel to air.

Embodiments of the invention also include specific geometric relationships between components of the pre-ignition conduit and pulverized fuel nozzle. In particular, the internal diameter D of the pulverized fuel nozzle is an important burner design parameter. As such, embodiments utilize geometric relationships between the inner diameter D and various other parameters, such as, for example, an internal diameter d of the duct of the pre-ignition conduit.

More specifically, in certain embodiments, the geometry of the inner diameter D of the pulverized fuel nozzle is such that if D is smaller than 500 mm, than the internal diameter of the duct d is be greater than that of the half of D. In other words, if D<500 mm, then d≥D/2. With respect to this relationship, it has been determined that if the diameter d is smaller than that of D/2, the temperature of the pre-ignition conduit will increase too rapidly and remain high during ignition and boiler start-up process, i.e, when the igniter is in operation. As will be appreciated, this can potentially damage and/or decrease the lifespan of the pulverized fuel nozzle.

Moreover, in aspects, if the pulverized fuel nozzle internal diameter D is between 500 mm and 600 mm, then the internal diameter d of the duct 16 is between 250 mm and 300 mm. That is, if 500 mm≤D≤600 mm, then 250 mm≤d≤300 mm. This relationship is significant in that if the diameter d is smaller than 250 mm, the temperature of the pre-ignition conduit can again increase too quickly and remain high during ignition and boiler start up, potentially decreasing the lifespan of the pulverized fuel nozzle. Conversely, if the diameter d is greater than 300 mm, the temperature of the pre-ignition conduit will remain low during ignition and boiler start up process, potentially decreasing coal ignition performance.

In other aspects, if the pulverized fuel nozzle internal diameter D is greater than 600 mm, then the internal diameter d of the duct 16 is smaller than that of the half of the pulverized nozzle internal diameter D, i.e., if D>600 mm, then d≤D/2. Here, if the diameter d is greater than that of D/2, the temperature of the pre-ignition conduit will remain low during ignition and boiler start up, again potentially decreasing coal ignition performance.

In certain embodiments, the internal diameter d of the duct 16 is smaller than that of the one third of the pulverized fuel nozzle double inner diameter D. That is, d≤2D/3.This relationship is notable in that if the diameter d is greater than that of the 2D/3, it will affect ignition such that the concentration of the pulverised fuel is decreased. Additionally, it is recommended to have an inner diameter of the second or subsequent downstream stage ignition conduit greater than one third of the pulverized-fuel nozzle inner double diameter D.

Continuing to refer to FIG. 1, in addition to the above geometric relationships involving the inner diameter of the pulverized fuel nozzle D, other geometric relationships may be utilized to optimize the concentration of pulverized fuel. For example, in embodiments, the igniter outlet, e.g., plasma outlet, is spaced apart from the cone-shaped concentrator 12 at a distance S. In particular embodiments, the distance S is between about 50 mm and 150 mm, i.e., 50 mm≤S≤150 mm. More particularly, the distance is about 100 mm. Notably, if distance S is smaller than about 50 mm, the inlet area of the cone-shaped concentrator 12 may be partially blocked thus affecting pulverised fuel concentration into the pre-ignition conduit. If the distance S is greater than about 150 mm the ignition of the pulverized fuel could potentially occur upstream the cone-shaped concentrator 12, therefore affecting burner and igniter lifespan.

Moreover, in aspects, the cone-shaped concentrator 12 has an internal diameter, M, that is greater than an inner diameter d of the duct by factor of about 1.1 to about 1.3. In particular embodiments, the internal diameter M of the cone-shaped concentrator 12 is greater than that of the internal diameter d by factor 1.2. In other words, the relationship between the internal diameter M and d can be expressed as $d\times1.1\leq M\leq d\times1.3$. Here, it has been determined that if the factor is greater or less than 1.2, the pulverized fuel concentration and the collection and transport of the pulverised fuel into the duct can be negatively affected.

Additionally, in embodiments, the internal diameter of the duct d is greater than an outer diameter P of the igniter outlet, i.e., d≥P. This is significant in that if the diameter d is smaller, the concentration of pulverized fuel, e.g., coal, decreases and the ignition process may be negatively affected.

In certain embodiments, the pre-ignition conduit has an overall length L which is greater than the internal diameter D of the nozzle, i.e., L≥D. This relationship is notable in that if the length L is smaller, the residence time of the pulverized fuel in the pre-ignition conduit decreases, thereby affecting ignition.

Referring now to FIGS. 4A through 4C, the PF/air mixture concentration in the pressurized fuel pre-ignition conduit varies based on cone geometry and the spacing S of the igniter/plasma generator from the cone. More specifically, FIGS. 4A and 4B illustrate that the concentration varies depending upon the distance S. FIGS. 4B and 4C show that the concentration varies based on the shape and geometry of the cone.

As shown in FIG. 5, in certain embodiments, the pre-ignition conduit 100 can be configured for use in a nozzle 140 that includes a tilt mechanism 150. In the depicted embodiment, the nozzle 140 includes an integrated igniter/plasma generator 120, the pre-ignition conduit 100 and a second stage ignition conduit or chamber 126. A distal portion of the nozzle 170 can tilt about an axis A via the tilt mechanism 150. As will be appreciated, embodiments of the pre-ignition conduit 100 may be incorporated into nozzles have other tilt or rotational mechanisms.

Referring now to FIGS. 6A-6B, in embodiments, the pre-ignition conduit 400 may include a cone 412 and a duct 416 that features an ignition inlet 410. The ignition inlet 410 is configured for receipt of an ignition source, e.g., plasma torch, (not shown). In certain embodiments, the ignition inlet 410 is at an angle a that is between about 30 and about 90 degrees. In other words, and $30°<\alpha<90°$. As will be appreciated, in this embodiment, the ignition source fires into the pre-ignition conduit itself and is not spaced apart from the cone at distance S. This embodiment may, however, utilize the various cone configurations and other geometric relationships described herein, and may be placed within a nozzle equipped with a tilt-mechanism.

In embodiments, a pre-ignition conduit for a pulverized fuel nozzle includes a duct having first and second opposing end portions, the first end portion configured to face an outlet of an igniter, a cone-shaped concentrator secured to the first end portion and located between the outlet of the igniter and the duct and configured to collect and forward pulverized fuel into the duct for ignition within the duct. The pre-ignition conduit functions as an ignition chamber within a pulverized fuel nozzle. The cone-shaped concentrator may include an eccentric cone or have a circumferential edge portion that is discontinuous. The cone-shaped concentrator can be located at a distance of about 50 mm to about 150 mm from the igniter outlet. The pulverized fuel nozzle has an inner diameter D and the duct of the pre-ignition conduit has an inner diameter d; and if D>500 mm then d≥D/2. In embodiments, if 500 mm≤D≤600 mm then 250 mm≤d≤300 mm. Moreover, in aspects, if D>600 mm then d≤D/2 and d can be ≤2D/3. In embodiments, the outlet of the igniter has an outer diameter P and d≥P. The pre-ignition conduit has an overall length L and L≥D. The cone-shaped concentrator can have a cone angle β that is between 5 and 45 degrees and between 15 and 30 degrees. The cone-shaped concentrator has an inner diameter M and the duct of the pre-ignition conduit has an inner diameter d and $d\times1.1\leq M<d\times1.3$.

In embodiments, a pulverized fuel nozzle includes an igniter having an outlet, a pre-ignition conduit that includes a duct have first and second opposing end portions, the first end portion configured to face the outlet of the igniter and a cone-shaped concentrator secured to the first end portion between the outlet and the duct, the cone-shaped concentrator configured to collect and forward pulverized fuel into the duct for ignition within the duct. The pre-ignition conduit functions as an ignition chamber within the pulverized fuel nozzle. The cone-shaped concentrator may include an eccentric cone or have a circumferential edge portion that is discontinuous. The cone-shaped concentrator can be located at a distance of about 50 mm to about 150 mm from the igniter outlet. The pulverized fuel nozzle has an inner diameter D and the duct of the pre-ignition conduit has an inner diameter d; and if D>500 mm then d≥D/2.In embodiments, if 500 mm≤D≤600 mm then 250 mm≤d≤300 mm. Moreover, in aspects, if D>600 mm then d≤D/2 and d can be ≤2D/3. In embodiments, the outlet of the igniter has an outer diameter P and d≥P. The pre-ignition conduit has an overall length L and L≥D. The cone-shaped concentrator can have a cone angle β that is between 5 and 45 degrees and between 15 and 30 degrees. The cone-shaped concentrator has an inner diameter M and the duct of the pre-ignition conduit has an inner diameter d and $d\times1.1\leq M\leq d\times1.3$. The pulverized fuel nozzle may include a tilt mechanism.

In yet another embodiment, a pre-ignition conduit for a pulverized fuel nozzle includes a duct having first and second opposing end portions, the first end portion configured to face an outlet of an igniter. The duct further includes an ignition outlet or side access duct for installation of an ignition source onto the pre-ignition conduit. The ignition outlet is at an angle a that ranges from between about 30 and 90 degrees, in other words, $30°<\alpha<90°$ . The conduit can also include a concentrator secured to the first end portion and located between the outlet of the igniter and the duct and configured to collect and forward pulverized fuel into the duct for ignition within the duct.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A pre-ignition conduit for a pulverized fuel nozzle comprising:

a duct having first and second opposing end portions, the first end portion facing an outlet of an igniter;

a cone-shaped concentrator for collecting and forwarding pulverized fuel into the duct for ignition, the cone-shaped concentrator being secured to the first end portion and located between the outlet of the igniter and the duct, wherein the cone-shaped concentrator includes an eccentric cone; and wherein the pre-ignition conduit functions as an ignition chamber within a pulverized fuel nozzle.

2. The pre-ignition conduit of claim 1 wherein the cone-shaped concentrator has a circumferential edge portion that includes a discontinuity.

3. The pre-ignition conduit of claim 1 wherein the cone-shaped concentrator is located at a distance of about 50 mm to about 150 mm from the igniter outlet.

4. The pre-ignition conduit of claim 1 wherein the pulverized fuel nozzle has an inner diameter D and the duct of the pre-ignition conduit has an inner diameter d; and wherein if $D>500$ mm then $d \geq D/2$.

5. The pre-ignition conduit of claim 1 wherein the pulverized fuel nozzle has an inner diameter D and the duct of the pre-ignition conduit has an inner diameter d; and wherein if 500 mm$\leq D \leq$600 mm then 250 mm$\leq d \leq$300 mm.

6. The pre-ignition conduit of claim 1 wherein the pulverized fuel nozzle has an inner diameter D and the duct of the pre-ignition conduit has an inner diameter d; and wherein if $D>600$ mm then $d \leq D/2$.

7. The pre-ignition conduit of claim 1 wherein the pulverized fuel nozzle has an inner diameter D and the duct of the pre-ignition conduit has an inner diameter d and $d \leq 2D/3$.

8. The pre-ignition conduit of claim 1 wherein the duct of the pre-ignition conduit has an inner diameter d and the outlet of the igniter has an outer diameter P and $d \geq P$.

9. The pre-ignition conduit of claim 1 wherein the pulverized fuel nozzle has an inner diameter D and pre-ignition conduit has an overall length L and $L>D$.

10. The pre-ignition conduit of claim 1 wherein the cone-shaped concentrator has a cone angle β that is between 5 and 45 degrees.

11. The pre-ignition conduit of claim 10 wherein the cone angle β is between 15 and 30 degrees.

12. The pre-ignition conduit of claim 1 wherein the cone-shaped concentrator has an inner diameter M and the duct of the pre-ignition conduit has an inner diameter d and $d \times 1.1 \leq M \leq d \times 1.3$.

13. A pulverized fuel nozzle for a burner having an internal diameter D, the nozzle comprising:

an igniter having an outlet;

a pre-ignition conduit that includes a duct have first and second opposing end portions, the first end portion configured to face the outlet of the igniter and a cone-shaped concentrator for collecting and forwarding pulverized fuel into the duct for ignition wherein the cone-shaped concentrator includes an eccentric cone, the cone-shaped concentrator being secured to the first end portion and located between the outlet of the igniter and the duct; and wherein the pre-ignition conduit functions as an ignition chamber within the pulverized fuel nozzle.

14. The pulverized fuel nozzle of claim 13 wherein the cone-shaped concentrator has a circumferential edge portion that is discontinuous.

15. The pulverized fuel nozzle of claim 13 wherein the cone-shaped concentrator is located at a distance of about 50 mm to about 150 mm from the igniter outlet.

16. The pulverized fuel nozzle of claim 13 wherein the pulverized fuel nozzle has an inner diameter D and the duct of the pre-ignition conduit has an inner diameter d; and wherein if $D>500$ mm then $d \geq D/2$.

17. The pulverized fuel nozzle of claim 13 wherein the pulverized fuel nozzle has an inner diameter D and the duct of the pre-ignition conduit has an inner diameter d; and wherein if 500 mm $\leq D \leq 600$ mm then 250 mm$\leq d \leq 300$ mm.

18. The pulverized fuel nozzle of claim 13 Therein the pulverized fuel nozzle has an inner diameter D and the duct of the pre-ignition conduit has an inner diameter d; and wherein if $D > 600$ mm then $d \leq D/2$.

19. The pulverized fuel nozzle of claim 13 wherein the pulverized fuel nozzle has an inner diameter D and the duct of the pre-ignition conduit has an inner diameter d and $d \leq 2D/3$.

20. The pulverized fuel nozzle of claim 13 wherein the duct of the pre-ignition conduit has an inner diameter d and the outlet of the igniter has an outer diameter P and $d \geq P$.

21. The pulverized fuel nozzle of claim 13 wherein the pulverized fuel nozzle has an inner diameter D and pre-ignition conduit has an overall length L and $L \geq D$.

22. The pulverized fuel nozzle of claim 13 wherein the cone-shaped concentrator has a cone angle $\beta$ that is between 5 and 45 degrees.

23. The pulverized fuel nozzle of claim 22 wherein the cone angle $\beta$ is between 15 and 30 degrees.

24. The pulverized fuel nozzle of claim 13 wherein the cone-shaped concentrator has an inner diameter M and the duct of the pre-ignition conduit has an inner diameter d and $d \times 1.1 \leq M \leq d \times 1.3$.

* * * * *